US006593832B2

(12) United States Patent
Räty

(10) Patent No.: US 6,593,832 B2
(45) Date of Patent: Jul. 15, 2003

(54) COAXIAL CAVITY RESONATOR, FILTER AND USE OF RESONATOR COMPONENT IN A FILTER

(75) Inventor: Tuomo Räty, Raahe (FI)

(73) Assignee: Allgon AB, Taby (SE)

( * ) Notice: Subject to any disclaimer, the term of this patent is extended or adjusted under 35 U.S.C. 154(b) by 0 days.

(21) Appl. No.: 09/820,624

(22) Filed: Mar. 30, 2001

(65) Prior Publication Data

US 2001/0026202 A1 Oct. 4, 2001

(30) Foreign Application Priority Data

Mar. 30, 2000 (SE) ..... 0001143

(51) Int. Cl.[7] ..... H01P 7/04; H01P 1/202
(52) U.S. Cl. ..... 333/222; 333/206
(58) Field of Search ..... 333/203, 206, 333/207, 222, 223, 202, 224, 225

(56) References Cited

U.S. PATENT DOCUMENTS

| | | | | |
|---|---|---|---|---|
| 3,876,963 A | * | 4/1975 | Graham | 333/222 |
| 4,507,631 A | | 3/1985 | Louet et al. | 333/222 |
| 4,794,354 A | * | 12/1988 | Dinsmore et al. | 333/207 |
| 5,262,742 A | * | 11/1993 | Bentivenga | 333/203 |

FOREIGN PATENT DOCUMENTS

| | | | |
|---|---|---|---|
| EP | 0069785 A1 | | 1/1983 |
| EP | 0533394 A2 | * | 3/1993 |
| JP | 59-122201 | | 7/1984 |

OTHER PUBLICATIONS

Patent Abstracts of Japan, Abstract of JP 3–245601A (Matsushita Electric Ind. Co. Ltd.), Nov. 1, 1991.
Patent Abstract of JP 55147803 (Oki Electric Ind. Co. Ltd.), Nov. 18, 1980.

* cited by examiner

*Primary Examiner*—Robert Pascal
*Assistant Examiner*—Stephen E. Jones
(74) *Attorney, Agent, or Firm*—Jacobson Holman PLLC

(57) ABSTRACT

The present invention relates to a coaxial cavity resonator having walls delimiting cavity, and one resonator body having a conductive rod with a first end being in short circuit relation to a first wall of the cavity walls. the first end a cross-sectional area. The resonator further includes a first conductive supportive plate with a first side connected to the first end of each rod. The first side has a larger area than the cross-sectional area of the first end of the rod and a second side, opposite the first side, fo the supportive plate is electrically connected to the first wall. A retainer is provided in the first cavity wall to guide the supportive plate, and an attachment is provided to secure the first supportive plate to the retainer. The invention also relates to a filter and a use of a resonator component in a filter.

26 Claims, 5 Drawing Sheets

COAXIAL CAVITY RESONATOR, FILTER AND USE OF RESONATOR COMPONENT IN A FILTER

TECHNICAL FIELD

The present invention relates to a coaxial cavity resonator. The invention also relates to a filter and a use of a resonator component in a filter.

BACKGROUND OF THE INVENTION

Coaxial cavity resonators are widely used in telecommunication applications. It has been the aim of research and development to achieve smaller resonators and, at the same time, maintain or increase the Q-value of the resonators, i.e. increase the Q-value per volume.

A simplest type of coaxial cavity resonator comprises a rod, having a length of a quarter wavelength ($\lambda/4$), arranged inside a cavity, so called rod resonator. A first end of the rod is connected to the bottom wall of the cavity and the second end of the rod is in open-circuit relation to the cavity walls. To obtain a reasonable good Q-value, the cross-sectional diameter of the cavity should be approximately 3 times the diameter of the rod.

The most common way of attaching said rod to the bottom wall is by soldering. This manufacturing technique has the drawback of introducing a damaged surface at the joint, and thereby decreasing the Q-value of the resonator. Another drawback is difficulties in aligning the rod during assembly of the resonator.

Additional problem is coating of interior walls of cavity necessary to receive a high Q-value.

In European patent application EP 0 964 473, a filter is disclosed, see FIG. 1, which provides a cavity made from a material having a good electrical conductivity with integrated resonator bodies. By making the resonators from the same piece of material as the cavity walls, undesired effects at the joint between each resonator and the cavity wall can be avoided since there is no interfaces between them.

A drawback with the filter is that it is very expensive to manufacture. Another drawback is that it is not very flexible, since a new mold is required when manufacturing new filter having less or more resonators.

SUMMARY OF THE INVENTION

According to an aspect of the present invention there is provided a coaxial cavity resonator as specified by the coaxial cavity resonator including walls delimiting a cavity, and at least one resonator body including a conductive rod having a first end being in short circuit relation to a first wall of the cavity walls. The first end has a cross-sectional area. A first conductive supportive plate has a first side connected to the first end of each rod. The first side has a greater area than the cross-sectional area of the first end of the rod. A second side, opposite the first side of the supportive plate, is electrically connected to the first wall. A retainer is provided in the first cavity wall to guide the supportive plate. An attachment is provided to secure the first supportive plate to the retainer, and the supportive plate and at least a portion of the rod closest to the first end have a continuous conductive surface with high conductivity.

The present invention is also directed to a filter in which at least one of the described coaxial cavity resonator is mounted as specified in the filter and comprises conductive outer walls, an input and an output, and at least one resonator.

The invention is also directed to the use of a resonator component in a filter where the component forms a part of the inside of at least one cavity wall. The component comprises a conductive rod having a first end. The first end has a cross-sectional area. A first conductive supportive plate has a first side connected to the first end of the rod. The first side has a larger area than the cross-sectional area of the first end of the rod. A second side, opposite the first side of the supportive plate, is electrically connectable to a cavity wall of the filter, and the supportive plate and at least a portion of the rod closest to the first end have a continuous conductive surface having high conductivity.

An advantage with the present invention is that the resonator body is easier to align during manufacture.

Another advantage with the present invention is that the resonators are easy to assembly, since they can be made of relatively few parts.

Another advantage is that the present invention is cheap to manufacture.

Embodiments of the present invention are described below, by way of example only.

DETAILED DESCRIPTION OF THE PREFERRED EMBODIMENTS

Figure 1:
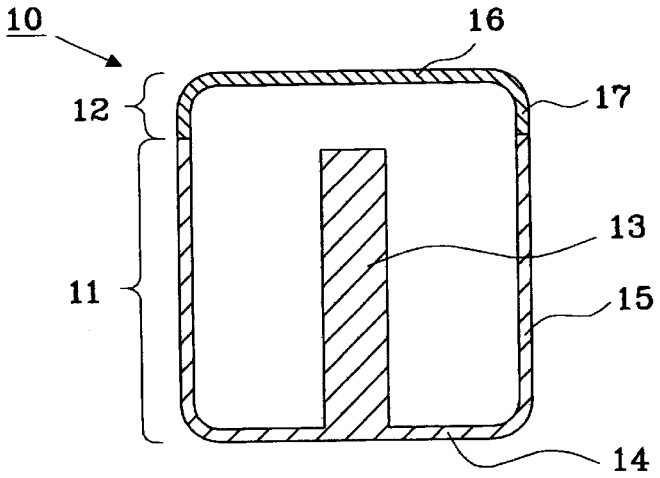
Fig. 1 (Prior Art)
FIG. 1 shows a prior art quarter wavelength coaxial cavity resonator.

FIG. 1 shows a schematic cross-section of the parts of a prior art resonator 10, the parts being a frame 11 and a lid part 12. The frame part comprises an inner conductor 13, i.e. resonator body, a bottom wall 14 and side walls 15. The lid part comprises a lid 16 and edges 17. The parts are dimensioned so that when the lid part is attached to the frame part there is formed a tight, closed outer conductor, which encloses the inner conductor, as shown in the figure.

Each part is made from a metallic or metal containing material having good electrical properties in one piece, by extrusion or molding.

Figure 2A:
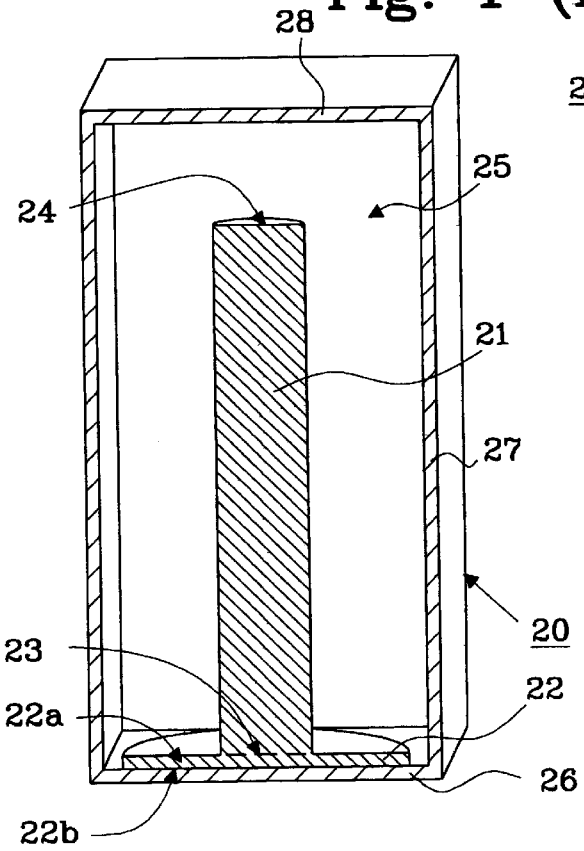
FIG. 2*a* shows a perspective view in cross section of a preferred embodiment of a quarter wavelength coaxial cavity resonator according to the present invention.
Figure 2B:
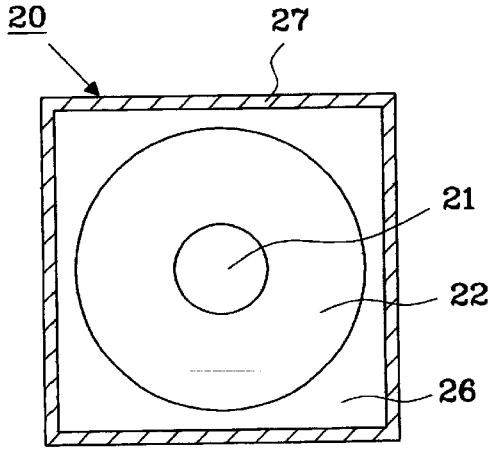
FIG. 2*b* shows a top view of the preferred embodiment in FIG. 2*a* with the top wall removed.

FIG. 2*a* shows a perspective view in cross section, and FIG. 2*b* shows a top view, of a first embodiment of a half wave coaxial resonator 20, according to the invention. The resonator body, in this example, comprises of a rod 21 connected to a first side 22*a* of a circular supportive plate 22, at a first end 23 of the resonator rod 21. The axis of the supportive plate and the axis of the rod is preferably attached so that they coincide, as shown in FIG. 2*b*.

A second end 24, opposite said first end 23, of the rod 21 is in open-circuit relation to cavity walls delimiting a cavity 25. The cavity walls comprises a bottom wall 26, side walls 27 and a top wall 28. A second side 22*b*, opposite to said first side 22*a*, of said supportive plate 22 is conductively attached to the bottom wall 26, e.g. by soldering or conductive glue.

The rod 21 and the supportive plate 22 is preferably coated with a highly conductive material, such as silver, irrespective of if the rod 21 and the supportive plate 22 are made from one piece or from separate pieces of material.

An alternative to coating is to manufacture the rod and the plate in a solid highly conductive material.

If they are made from separate pieces they have to be conductively attached to each other, e.g. by soldering, preferably before coating. On the other hand if they are made from the same piece, it is easy to manufacture the rod and the supportive plate by machine tooling, e.g. turning, which is relatively cheap. The advantage with attaching the supportive plate 22 to the bottom wall 26 is that the Q-factor of the resonator increases due to a better conductivity across the bottom wall of the cavity. Another advantage is that the positioning of the rod 21 in the cavity 25, relative to the cavity walls 26–28, is easier during manufacturing.

Figure 3A:
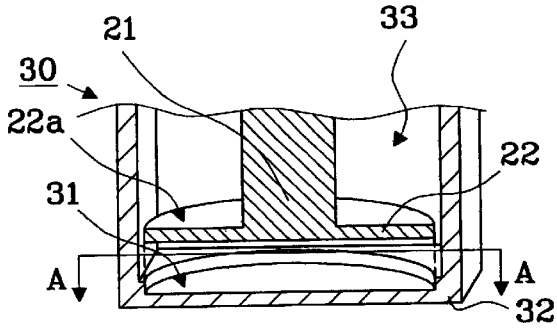
FIGS. 3*a* and 3*b* shows a second embodiment of a quarter wavelength coaxial cavity resonator.
Figure 3B:
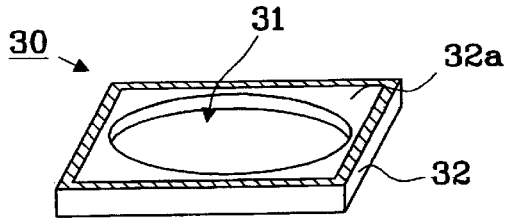

FIG. 3*a* shows an exploded cross-section, and FIG. 3*b* shows a view of the bottom wall along line A—A in FIG. 3*a*, of a second embodiment of a quarter wavelength coaxial cavity resonator 30, according to the invention. The resonator body comprises a rod 21 attached to a supportive plate 22 as described in connection to FIGS. 2*a* and 2*b*. In this embodiment, the supportive plate 22 is to be placed in a recess 31 in a bottom wall 32 of the cavity 33, where the shape of the recess essentially corresponds to the shape of the supportive plate 22. The size of the recess 31 is approximately the same as the size of the supportive plate 22. The thickness of the supportive plate 22 is preferably approximately the same as the depth of the plate shaped recess 31, i.e. The upper surface 22*a* of the supportive plate 22 is in flush with the upper part 32*a* of the bottom wall 32.

Normally the plate is a little smaller compared to the recess for mounting purposes and to obtain a good electric connection to the bottom wall, soldering or conductive glue may be used to fill out the space between them.

Figure 4A:
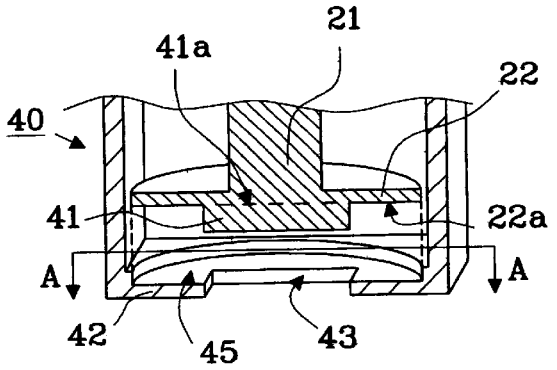
FIGS. 4*a* and 4*b* shows a third embodiment of a quarter wavelength coaxial cavity resonator.
Figure 4B:
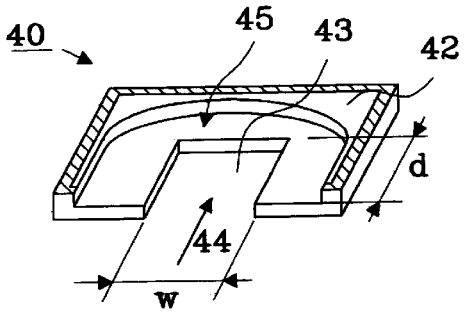

FIG. 4*a* shows an exploded cross section, and FIG. 4*b* shows a view of the bottom wall along line A—A in FIG. 4*a*, of a third embodiment of a half wavelength coaxial cavity resonator 40, according to the invention. The resonator body comprises a rod 21 attached to a supportive plate 22, as described above. The resonator 40 further comprises a guide member 41, where a first side 41*a* of said guide member 41 is attached to said second side 22*b* of said supportive plate 22.

The resonator 40 is also provided with a bottom wall 42 having an opening 43, adapted to hold said guide member 41. The element comprising the rod 21, the plate 22 and the guide member 41 is arranged in a desired position by sliding the guide member 41 in the elongated opening 43 in a direction marked by the arrow 44. The plate 22 rests in a recess 45, having an elongated, half rounded, shape. The position of the element inside the cavity is determined either by the half rounded shape of the recess 45, corresponding to the shape of the plate 22, and/or by the depth d and width w of the opening 43 holding the guide member 41. The guide member 41 may have any shape, but for manufacturing purposes a guide member having a circular cross section is preferred.

The element is preferably secured to the bottom wall 42 by soldering or conductive glue arranged on the outside of the cavity around the guide member 41.

The element comprising the rod 21, the supportive plate 22 and the guide member 41 is preferably coated with a highly conductive material, such as silver, irrespective of if the rod 21, the supportive plate 22 and the guide member 41 are made from one piece or from separate pieces of material.

An alternative to coating is to manufacture the rod, the plate and the guide member in a solid highly conductive material.

Figure 5:
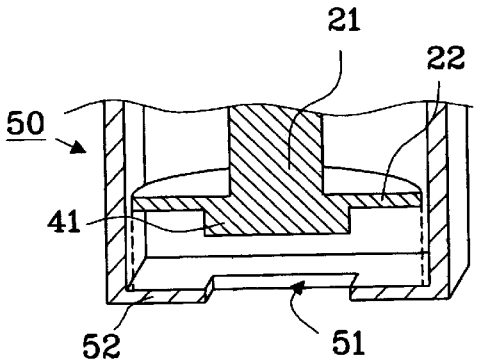
FIG. 5 shows a perspective view in cross section of a fourth embodiment of a quarter wavelength coaxial cavity resonator.

FIG. 5 shows an exploded view in cross-section of a fourth embodiment of a half wavelength coaxial resonator 50, according to the present invention. The element making up the rod 21, the supportive plate 22 and the guide member 41 is the same as described in connection with FIGS. 4*a* and 4*b*. The resonator 50 only has an opening 51, without any recess to hold the supportive plate, provided in the bottom wall 52. The opening may only be an opening corresponding to the shape and size of the guide member 41 or be an elongated opening as described in connection with FIG. 4*b*.

Figure 6:
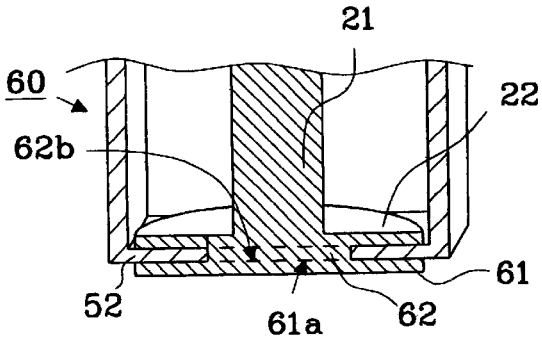
FIG. 6 shows a perspective view in cross section of a fifth embodiment of a quarter wavelength coaxial cavity resonator.

FIG. 6 shows a cross-section of a fifth embodiment of a half wavelength coaxial cavity resonator 60, according to the present invention, where the resonator is provided with a second supportive plate 61 in addition to the resonator in FIG. 5. A first side 61*a* of the second supportive plate 61 is attached to a second side 62*b* of a guide member 62. The length of the guide member 62 is preferably approximately the same as the thickness of the bottom wall 52.

The second supportive plate 61 is preferably made from the same piece of material as the rod 21, the supportive plate 22 (hereafter referred to as the first supportive plate) and the guide member 62. All the parts is preferably coated by, or made from, a highly conductive material.

The opening 63 in the bottom wall 52 corresponds to the opening described in connection with FIG. 4*b*. There may also be provided a recess (not shown), as described in FIG. 4*b*, on the inside of the bottom wall and/or on the outside of the bottom wall to further improve the performance of the resonator.

The recesses described in the above embodiments are easily manufactured by machine processing, e.g. by etching.

Figure 7A:
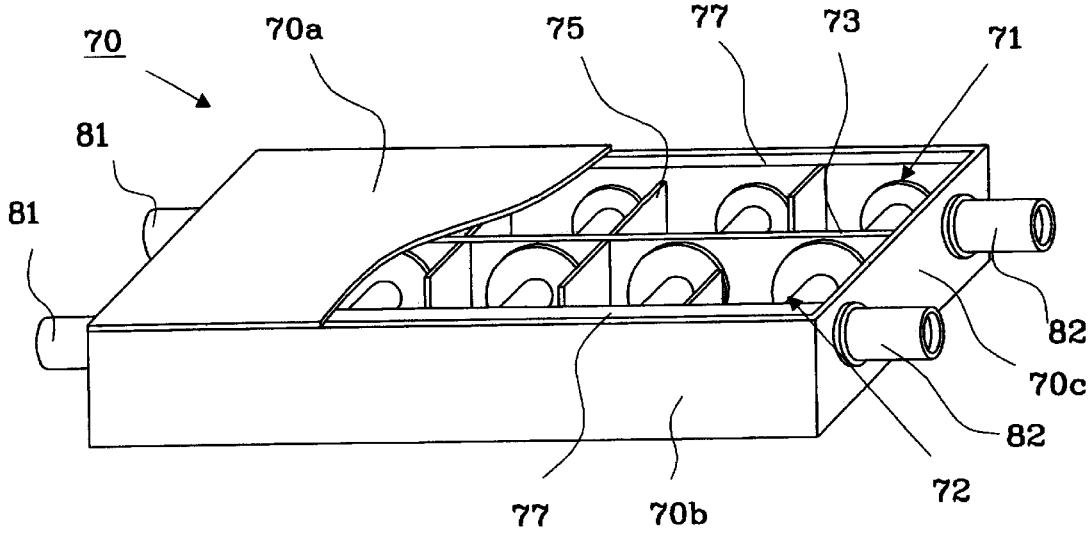
FIG. 7*a* shows a perspective view of a filter comprising several quarter wavelength coaxial resonators according to the present invention.
Figure 7B:
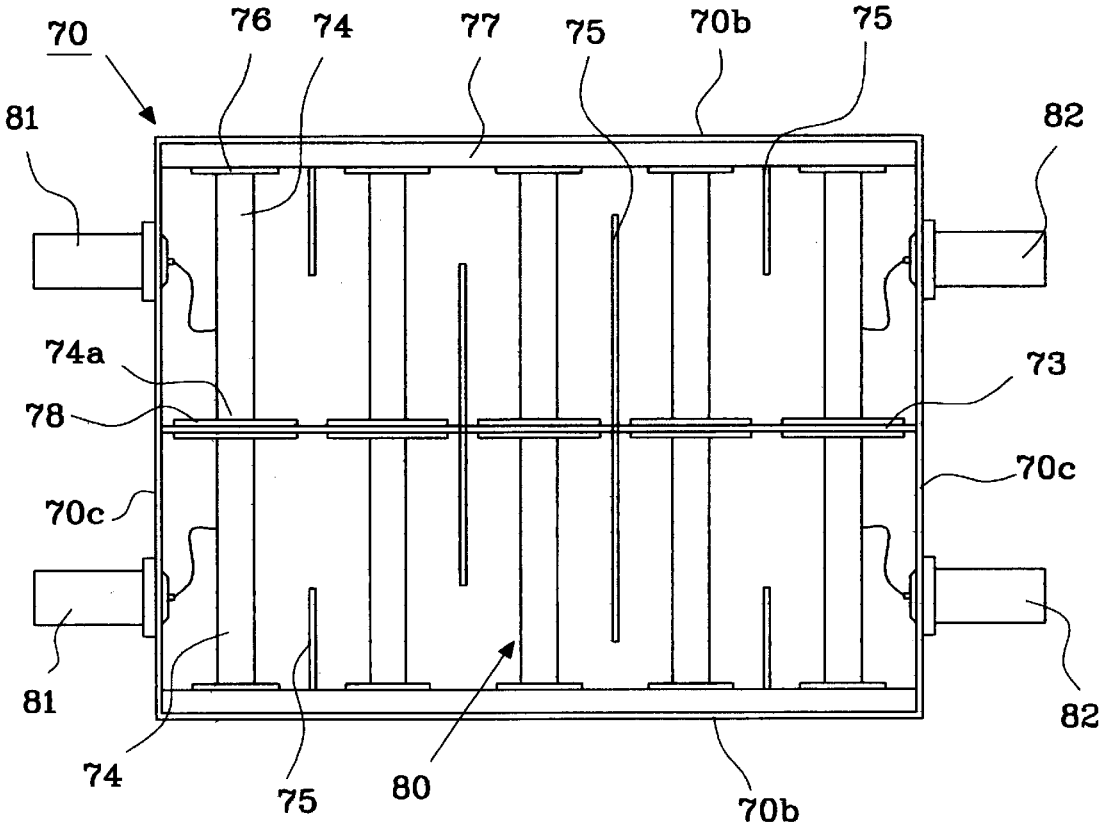
FIG. 7*b* shows a top view of the resonator in FIG. 7*a*, without the lid.

FIG. 7*a* shows a perspective view, and FIG. 7*b* shows a top view of a filter device 70 comprising two filters 71 and 72, where an upper housing portion, lid, 70*a*, of the device 70 is partly shown in FIG. 7*a*. A lower housing portion of said device 70 has outer walls constituting a top wall 70*b* and side walls 70*c*, for each of the included cavities in the filters 71, 72. The filters 71, 72 are separated by a common internal wall 73, which constitutes a bottom wall for each of the included cavities in the filters 71, 72. Each filter comprises a number of resonators, for instance five resonator bodies, separated by internal walls 75. In this example the internal walls separates the upper part or the lower part of the resonator bodies from each other.

In this example each resonator body comprises a rod 74, having a first end 74*a*connected to the bottom wall 73 via a supportive plate 78, and a hat 76 attached to a second end 74*b*, opposite said first end 74*a*, of said rod 74. Further more a ceramic plate 77 is arranged between the hat 76 and the top wall 70*b* to further improve the properties of each filter. This type of resonator is described in more detail in the Swedish patent application SE9904411-7 by the same applicant with the title "A coaxial cavity resonator and a method for manufacturing a coaxial cavity resonator", which is hereby incorporated by reference.

Figure 8:
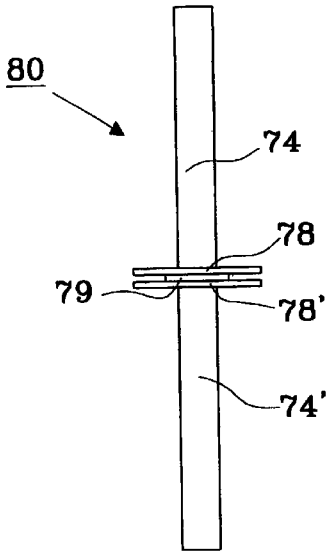
FIG. 8 shows a perspective view in cross section of a double quarter wavelength resonator body according to the present invention.

In this example, two adjacent resonators sharing the same bottom wall 73 include an element 80, which comprises a first rod 74, a first supportive plate 78, a guide member 79, a second supportive plate 78' and a second rod 74'. The element 80 is preferably coated by a highly conductive material and preferably made from the same piece of material, as shown in FIG. 8. The element 80 is similar to the element described in connection with FIG. 6 with the addition of the second rod 74'.

Figure 9:
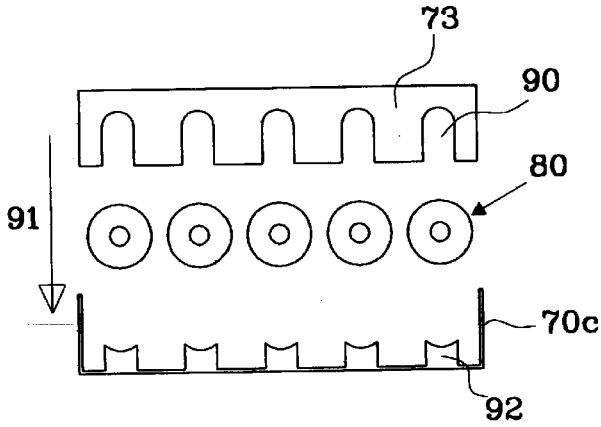
FIG. 9 shows an exploded side view of a way to assemble the double resonator bodies to the bottom wall in the filter in FIG. 7*a*.

Each element 80 is held in a desired position by inserting the guide member 79 in an opening 90, having an alternative shape compared to the opening described in connection with FIG. 6, in the common internal wall (bottom wall) 73, as shown in FIG. 9, which is an exploded view. Each element 80 is preferably held in position by friction when inserted, which is obtained by adapting the length of the guide member 79 to the thickness of the bottom wall 73.

The bottom wall 73 carrying the elements 80 is then placed in the lower housing portion making up the top walls 70*b* and the side walls 70*c* as indicated by the arrow 91. The side wall 70*c* is preferably provided with protrusions 92, having the same thickness, or thinner, as the bottom wall 73, and having a shape corresponding to the opening not containing the guide member 79. This way the bottom wall 73 does not have any openings after assembling allowing undesired coupling between resonators sharing the same bottom wall 73.

The protrusions 92 may be made by folding up a part of, or by attaching separate plates to, the side wall 70*b* on which the bottom wall 73 is to be attached to. Alternative ways of providing protrusions is by using die casting, extrusion, machining or other similar techniques.

An input 81 and an output 82 is also provided to each filter 71, 72.

Although the invention is described together with quarter wavelength resonators, which is preferred, the invention may naturally be implemented in other types of resonators, such as half wavelength resonators. A few different embodiment relating to half wavelength resonators is described hereinafter.

Figure 10:
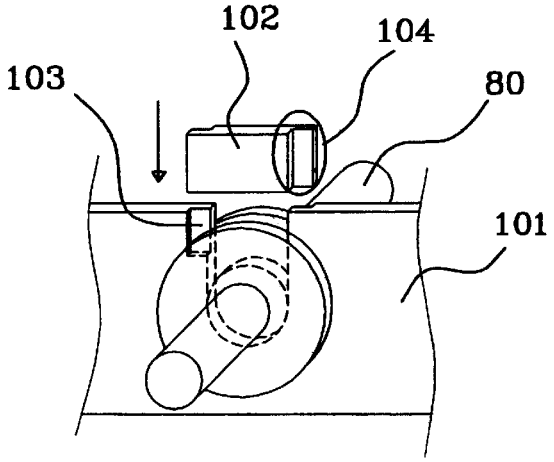
FIG. 10 shows a perspective view of an alternative way of assemble the double resonator to the bottom wall in FIG. 7*a*.

FIG. 10 shows a perspective view of an alternative way of assembling the double resonator element 80 to a bottom wall 101. The difference to the way described in connection with FIG. 9 is that the protrusions 102 are separately provided and have an overlapping shape to prevent any openings in the bottom wall 101 when assembled. By providing an overlapping structure both in each opening 103 and each protrusion 104 the leakage of electromagnetic field between the cavities sharing bottom wall 101 may be reduced and performance increased.

Although the invention is described together with quarter wavelength resonators, which is preferred, the invention may naturally be implemented in other types of resonators, such as half wavelength resonators. A few different embodiment relating to half wavelength resonators is described hereinafter.

Figure 11:
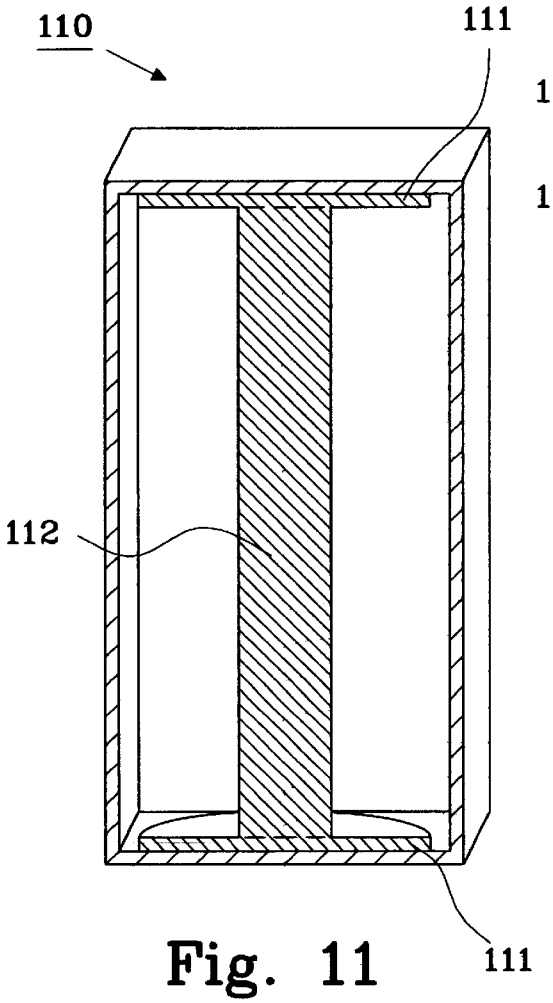
FIG. 11 shows a perspective view in cross section of a first embodiment of a half wavelength coaxial cavity resonator according to the present invention.
Figure 12:
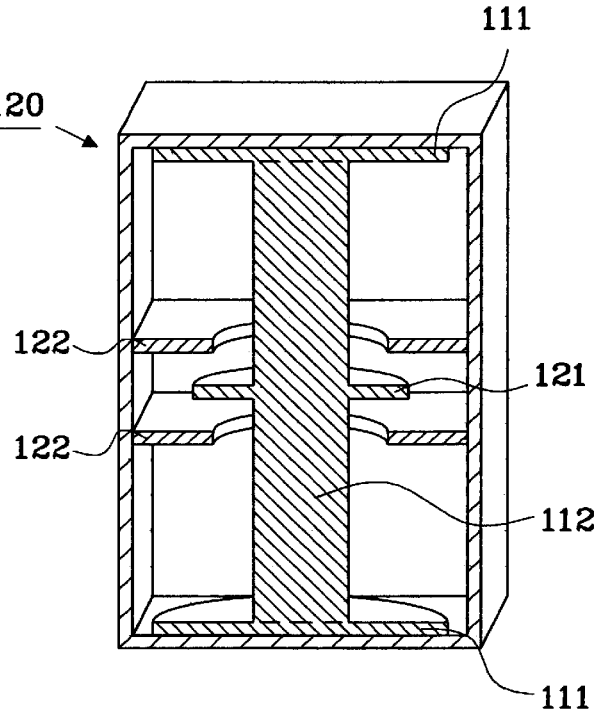
FIG. 12 shows a perspective view in cross section of a second embodiment of a half wavelength coaxial cavity resonator according to the present invention.
Figure 13:
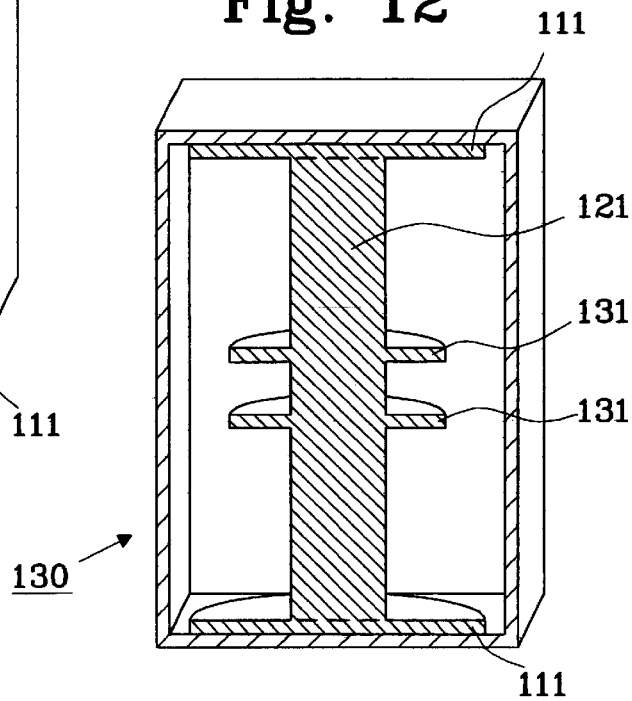
FIG. 13 shows a perspective view in cross section of a third embodiment of a half wavelength coaxial cavity resonator according to the present invention.

FIGS. 11–13 shows three embodiments of a half wavelength resonator comprising supportive plates according to the invention.

FIG. 11 shows a half wavelength coaxial cavity resonator 110 comprising a supportive plate 111 at each end of a resonator rod 112 connected in a way as described in connection with FIGS. 2*a* and 2*b*. The volume of the resonator is larger than for a quarter wavelength resonator, as described above, for the same frequency. The mechanical stability of the resonator is higher than for a quarter wavelength resonator as described in FIGS. 2–6.

FIGS. 12 and 13 shows half wavelength coaxial cavity resonators 120 and 130, having a reduced cavity volume compared to the resonator in FIG. 11 working in the same frequency.

In FIG. 12, by adding a conductive disc 121 to the rod 112, approximately half way between the supportive plates 111, and at the same time adding plates 122 to the cavity wall close to the conductive disc 121, the length of the cavity may be reduced.

In FIG. 13, by adding two conductive discs 131 symmetrically to the rod 112 essentially half way between the supportive plates 111, the length of the cavity may be reduced.

FIGS. 11–13 illustrates that the inventive concept may be applied to a half wavelength resonator as well as a quarter wavelength resonator. Other combinations of conductive discs and added plates may be used in the half wavelength resonator to further shorten the length of the resonator, such is disclosed in the International publication WO 00/10220 by the same applicant, which is hereby incorporated as reference.

FIGS. 2–6 only discloses a quarter wavelength coaxial cavity resonator having a single rod as a resonator body, but it is apparent to a person skilled in the arts that any type of resonator body may benefit from the inventive concept of the present invention, as indicated in connection with FIGS. 7–13.

Normally, the inside of a cavity have to be coated with some conductive material to obtain a good performance of the resonator. By adding these supportive plates the need for coating the inside of the cavity is reduced, since the supportive plate preferably is coated with a conductive material and the strongest current in the cavity is concentrated around the end of the rod closest to the conductive plate. The surface of the supportive plate, facing inside the cavity, is preferably as large as the size of the bottom wall, or at least as large as possible. A non-circular, e.g. square, rectangular or elliptic, shape of the supportive plate is also possible, but the preferred shape is circular due to manufacturing requirements.

What is claimed is:

1. A coaxial cavity resonator comprising:

walls delimiting a cavity, at least one resonator body including a conductive rod having a first end being in short circuit relation to a first wall of said cavity walls, said first end having a cross-sectional area, a first conductive supportive plate having a first side being connected to the first end of each rod, said first side having a greater area than said cross-sectional-area of the first end of the rod, a second side, opposite said first side, of the supportive plate being electrically connected to said first wall, and said first conductive plate being arranged within the cavity, a retainer being provided in said first cavity wall to guide said supportive plate, an attachment being provided to secure said first supportive plate to said retainer, said supportive plate and at least a portion of the rod closest to said first end have a continuous conductive surface having high conductivity, a guide member being provided on said resonator body, having a first side being connected to said second side of the first supportive plate, and said retainer including an opening, said opening being provided in said first wall to guide said guide member and to hold said first supportive plate and resonator rod inside the cavity.

2. The resonator according to claim 1, wherein said first supportive plate is arranged essentially perpendicular to said rod.

3. The resonator according to claim 1, wherein said retainer comprises a recess having approximately the same shape as said first supportive plate.

4. The resonator according to claim 3, wherein the depth of said recess is essentially equal to the thickness of said first supportive plate, whereby said plate is in flush with the first cavity wall when arranged in said recess.

5. The resonator according to claim 1, wherein said plate has a circular shape.

6. The resonator according to claim 1, wherein at least said rod and said first supportive plate is coated with a highly conductive material.

7. The resonator according to claim 1, wherein said guide member has a circular cross section.

8. The resonator according to claim 1, wherein said resonator further comprises:

a second supportive plate being connected to a second side, opposite to said first side, of said guide member essentially in parallel with said first plate at a distance defined by the length of said guide member, said distance between said plates being approximately the same as the thickness of the first wall.

9. The resonator according to claim 8, wherein said distance is equal or greater than the thickness of the first wall.

10. The resonator according to claim 8, wherein said second supportive plate is arranged in a second cavity, and where a first end of a second rod is connected to said second supportive plate, opposite the side being attached to said guide member.

11. The resonator according to claim 10, wherein said second rod is essentially perpendicularly attached to said second supportive plate.

12. The resonator according to claim 10, wherein said second supportive plate has a circular shape.

13. The resonator according to claim 10, wherein said rod, said first supportive plate, said guide member, said second supportive plate and said second rod are made from the same piece of material.

14. The resonator according to claim 8, wherein said rod, said first supportive plate, said guide member and said second supportive plate are made from the same piece of material.

15. The resonator according to claim 1, wherein said attachment is provided by glue.

16. The resonator according to claim 1, wherein said rod and first supportive plate are made from the same piece of material.

17. The resonator according to claim 1, wherein said rod, said first supportive plate and said guide member are made from the same piece of material.

18. The resonator according to claim 1, wherein said attachment is provided by friction.

19. The resonator according to claim 1, wherein said attachment is provided by soldering or welding.

20. The resonator according to claim 1, wherein a second end, opposite to said first end, of at least one resonator rod is in open circuit relation to said cavity walls.

21. The resonator according to claim 1, wherein a second end, opposite to said first end, of at least one resonator rod is in short circuit relation to said cavity walls.

22. A filter comprising:

conductive outer walls, an input and an output, and at lease one resonator including a conductive rod having a first end being in short circuit relation to a first wall of said outer walls, said first end having a cross-sectional area, a first conductive supportive plate having a first side being connected to the first end of each rod, said first side having a greater area than said cross-sectional area of the first end of the rod, a second side, opposite said first side of the supportive plate, being electrically connected to said first wall, and said first conductive plate being arranged within a cavity, a retainer being provided in said first wall to guide said supportive plate, an attachment being provided to secure said first supportive plate to said retainer, said supportive plage and at least a portion of the rod closest to said first end have a continuous conductive surface having high conductivity, a guide member being provided on said resonator body, having a first side being connected to said second side of the first supportive plate, and said retainer including an opening, said opening being provided in said first wall to guide said guide member and to hold said first supportive plate and resonator rod inside the cavity.

23. The filter according to claim 22, wherein said filter further comprises at least one internal wall, electrically connected to at least one of the outer walls, that at least partially screens two adjacent resonator bodies from each other.

24. A use of at least one resonator component in a filter, where said component forms a part of the inside of at least one cavity wall, said component comprising:

a conductive rod having a first end, said first end having cross-sectional area, a first conductive supportive plate having a first side being connected to the first end of said rod, said first side having a larger area than said cross-sectional area of the first end of the rod, a second side, opposite said first side, of the supportive plate being electrically connectable to a cavity wall of said filter, said supportive plate and at least a portion of the rod closest to said first end have a continuous conductive surface having high conductivity, a guide member having a first side being connected to said second side of the first supportive plate, and where said guide member is mountable in an opening provided in said cavity wall, a second supportive plate being connected to a second side, opposite to said first side, of said guide member essentially in parallel with said first plate at a distance defined by the length of said guide member, said distance between said plates being approximately the same as the thickness of the cavity wall, whereby said second supportive plate forms a part of a cavity wall in an adjacent cavity.

25. The use according to claim 24, wherein said component comprises a first end of a second conductive rod being connected to said second supportive plate, opposite the side being attached to said guide member, said second rod forming a resonator in said adjacent cavity.

26. The use according to claim 24, wherein said component is made by turning.

* * * * *